US006821188B2

(12) United States Patent
Tank et al.

(10) Patent No.: US 6,821,188 B2
(45) Date of Patent: Nov. 23, 2004

(54) DIAMOND COMPACT

(76) Inventors: Klaus Tank, 9 Warbleton Ave., Johannesburg, 2007 (ZA); Noel John Pipkin, 138/140 Pritchard St., Johannesburg North, 2153 (ZA); Johan Myburgh, 13 Shelley Dr., Lakefield, Benoni, 1501 (ZA)

( * ) Notice: Subject to any disclaimer, the term of this patent is extended or adjusted under 35 U.S.C. 154(b) by 0 days.

(21) Appl. No.: 10/425,940

(22) Filed: Apr. 30, 2003

(65) Prior Publication Data

US 2003/0206821 A1 Nov. 6, 2003

Related U.S. Application Data

(62) Division of application No. 09/673,243, filed as application No. PCT/ZA99/00017 on Apr. 20, 1999, now Pat. No. 6,620,375.

(30) Foreign Application Priority Data

Apr. 22, 1998 (ZA) ..... 98/3381

(51) Int. Cl.[7] ..... B24B 1/00
(52) U.S. Cl. ..... 451/28; 451/56
(58) Field of Search ..... 451/28, 56; 144/359, 144/363, 365

(56) References Cited

U.S. PATENT DOCUMENTS 2,947,609 A 8/1960 Strong ..... 23/209.1
2,947,610 A 8/1960 Hall ..... 23/209.1
3,745,623 A 7/1973 Wentorf, Jr. et al. ..... 29/95 B
3,831,428 A 8/1974 Wentorf, Jr. et al. ..... 72/467
4,124,401 A * 11/1978 Lee et al. ..... 501/90
4,234,661 A * 11/1980 Lee et al. ..... 428/446
4,374,900 A 2/1983 Hara et al.
4,534,773 A * 8/1985 Phaal et al. ..... 51/293
4,534,934 A 8/1985 Cho ..... 419/6
4,793,828 A * 12/1988 Burnand ..... 51/293
4,875,907 A 10/1989 Phaal et al.
4,899,922 A 2/1990 Gigl et al.
4,964,139 A * 10/1990 Wash et al. ..... 375/239
4,985,051 A 1/1991 Ringwood
5,603,070 A * 2/1997 Cerutti et al. ..... 419/6
5,773,140 A * 6/1998 Cerutti et al. ..... 428/332
5,925,197 A * 7/1999 Galli ..... 148/409
6,132,675 A * 10/2000 Corrigan et al. ..... 419/11
6,416,878 B2 * 7/2002 An ..... 428/565
6,620,375 B1 9/2003 Tank et al.

* cited by examiner

*Primary Examiner*—M. Rachuba
(74) *Attorney, Agent, or Firm*—Oblon, Spivak, McClelland, Maier & Neustadt, P.C.

(57) ABSTRACT

There is disclosed a method of abrading a product where a corrosive environment is experienced which includes the steps of using, as the abrading element, a composite diamond compact comprising a diamond compact bonded to a cemented carbide substrate, the diamond compact comprising a polycrystalline mass of diamond particles and a second phase containing diamond catalyst/solvent and a noble metal.

15 Claims, 1 Drawing Sheet

DIAMOND COMPACT

This application is a divisional of application Ser. No. 09/673,243 filed Dec. 5, 2000 Now U.S. Pat. No. 6,620,375, which is a 371 of PCT/2A99/00017 Apr. 20, 1999. The full text and drawings of that application are incorporated herein by reference.

BACKGROUND OF THE INVENTION

This invention relates to diamond compacts.

Diamond compacts, also known as polycrystalline diamond, are well known in the art and are used extensively in cutting, milling, drilling and other abrasive operations. Diamond compacts are polycrystalline in nature and contain a high diamond content. Diamond compacts may be produced without the use of a second or bonding phase, but generally contain such a phase. When such a phase is present, the dominant component of the phase is generally a diamond catalyst/solvent such as cobalt, nickel or iron or a combination thereof.

Diamond compacts are manufactured under elevated temperature and pressure conditions, i.e. conditions similar to those which are used for the synthesis of diamond.

Diamond compacts tend to be brittle and so in use they are usually bonded to a substrate, the substrate generally being a cemented carbide substrate. Bonding of the diamond compact to the substrate will generally take place during the manufacture of the compact itself. Diamond compacts bonded to a substrate are known as composite diamond compacts.

Diamond compacts and the substrates, particularly cemented carbide substrates, to which they are bonded, are not very corrosion resistant. It is an object of the present invention to improve the corrosion resistance of a diamond compact.

EP 0 714 695 describes a sintered diamond body having high strength and high wear resistance. The body comprises sintered diamond particles of 80 to 96 percent by volume and a remaining part of sintering assistant agent and unavoidable impurity. The sintered diamond particles have a particle size substantially in the range 0.1 to 10 microns and are directly bonded to each other. The sintering assistant agent includes palladium in a range of 0.01 to 40 percent by weight and a metal selected from iron cobalt and nickel. The diamond sintered body may be produced by precipitating the palladium on a surface of the particles and thereafter electroplating the iron, cobalt or nickel. An alternative method disclosed is to mix the iron, cobalt or nickel with the diamond powder having the palladium coated thereon. In one comparative example, cobalt powder is infiltrated into the diamond mass and is said to result in a product having unsintered portions and hence unsuitable.

U.S. Pat. No. 5,658,678 discloses a cemented carbide comprising a mass of carbide particles bonded into a coherent form with a binder alloy which comprises, as a major component, cobalt, and an additional component selected from one or more of ruthenium, rhodium, palladium, osmium, iridium and platinum. The cemented carbide is made by mixing the binder component with the carbide particles. There is no disclosure of the use of a cobalt/platinum group metal binder in the context of a sintered diamond product.

SUMMARY OF THE INVENTION

According to the present invention, a method of making a composite diamond compact comprising a polycrystalline mass of diamond particles present in an amount of at least 80 percent by volume of the compact and a second phase containing a diamond catalyst/solvent and a noble metal includes the steps of providing a cemented carbide substrate, providing a layer of diamond particles on a surface of the substrate, providing a source of diamond catalyst/solvent and noble metal, separate from the diamond particle layer, and causing the diamond catalyst/solvent and noble metal to infiltrate the diamond particles under diamond synthesis conditions producing a diamond compact.

DESCRIPTION OF EMBODIMENTS

The cemented carbide substrate comprises a mass of carbide particles bonded by means of a binder which will typically be cobalt, iron, nickel or an alloy containing one or more of these metals. The binder will also preferably contain a noble metal improving the corrosion resistance of the substrate.

Figure 1:
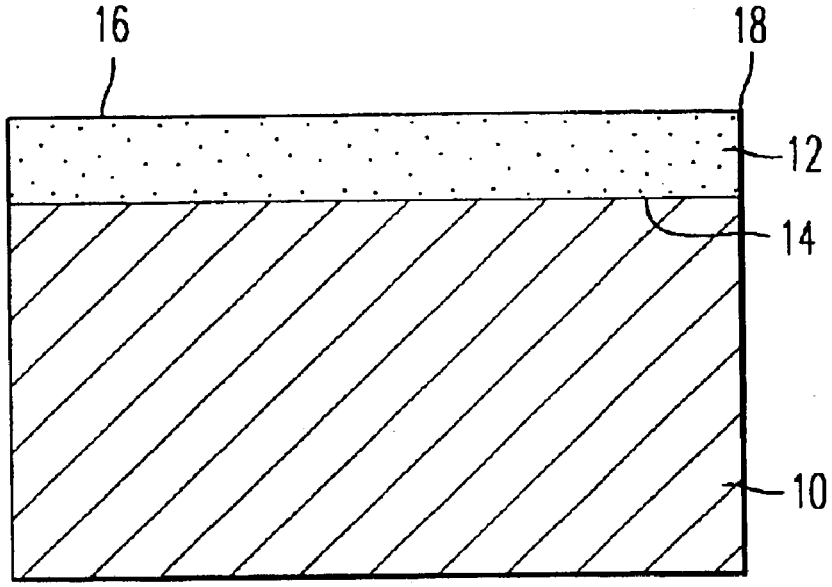
FIG. 1 illustrates a sectional side view of a composite diamond compact produced by an embodiment of the method of the invention.

The source of diamond catalyst/solvent and noble metal is separate and removed from the diamond particle layer and may thus be the cemented carbide substrate itself. The diamond catalyst/solvent and noble metal will infiltrate the diamond particles on application of the diamond synthesis conditions. In this form of the invention, the diamond catalyst and noble metal will be uniformly distributed through the diamond compact which is produced. This may be illustrated with reference to FIG. 1. Referring to this Figure, a composite diamond compact comprises a cemented carbide substrate 10 and a diamond compact 12 bonded to the substrate 10 along interface 14. The working surface of the diamond compact is 16 and the cutting edge 18. The distribution of diamond catalyst/solvent and noble metal will be uniformly distributed through the compact 12.

In another form of the invention, a source of diamond catalyst/solvent may be provided by the substrate and a layer of noble metal and optionally catalyst/solvent interposed between the diamond particles and the substrate. In this form of the invention, the noble metal will tend to have a higher concentration in the region of the working surface 16 and cutting edge 18 than in the region of the diamond compact closest to the interface 14. In one preferred form of this form of the invention, the cemented carbide has a catalyst/solvent binder, e.g. cobalt, and the interposed layer contains the noble metal and a different catalyst/solvent binder, e.g. nickel.

The second phase of the diamond compact of the invention is characterised by the presence of a noble metal which will generally be present in a minor amount. Preferably the noble metal is present in the second phase in an amount of less than 50 percent by mass. The noble metal may be gold or silver or a platinum group metal such as ruthenium, rhodium, palladium, osmium, iridium or platinum. The presence of the noble metal increases the corrosion resistance of the compact, particularly in environments which are acidic, alkaline or aqueous in nature, and corrosion arising out of metal attack, e.g. zinc attack.

Examples of suitable second phases for the diamond compact are:

| Metals | Amount of Noble Metal (mass %) |
|---|---|
| Cobalt - ruthenium | 0.05 to 25 |
| Nickel - ruthenium | 0.05 to 50 |
| Cobalt - palladium | 0.05 to 75 |
| Nickel - palladium | 0.05 to 75 |

Minor amounts of other diamond catalyst/solvents may be present in each one of these second phases.

The diamond catalyst/solvent may be any known in the art, but is preferably cobalt, iron, nickel or an alloy containing one or more of these metals.

The layer of diamond particles on a surface of the cemented carbide substrate will be exposed to diamond synthesis conditions to form or produce a diamond compact. This diamond compact will be bonded to the substrate. The diamond synthesis conditions will typically be a pressure in the range 40 to 70 kilobars (4 to 7 GPa) and a temperature in the range 1200 to 1600° C. These conditions will typically be maintained for a period of 10 to 60 minutes.

Figure 2:
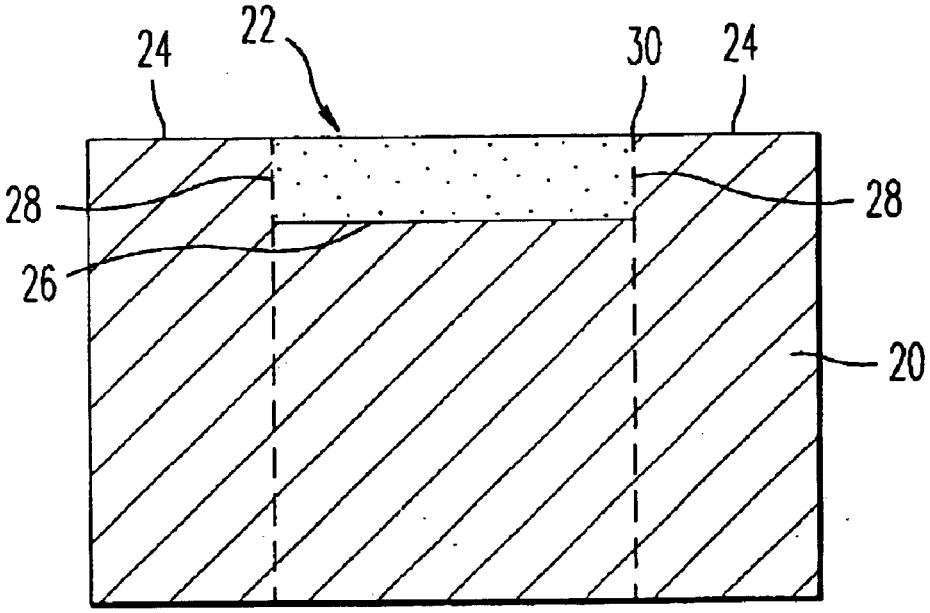
FIG. 2 illustrates a sectional side view of a cemented carbide substrate which can be used in the method of the invention.

The composite diamond compact will generally be produced from a carbide substrate, in a manner illustrated by FIG. 2. Referring to this Figure, a cemented carbide substrate 20 has a recess 22 formed in a surface 24 thereof. The cemented carbide substrate 20 will generally be circular in plan and the recess 22 will also generally be circular in plan. A layer of catalyst/solvent and noble metal may be placed on the base 26 of the recess 22. Alternatively, a cup of catalyst/solvent and noble metal may be used to line the base 26 and sides 28 of the recess. The catalyst/solvent and noble metal may be mixed in powder form or formed into a coherent shim. A mass of unbonded diamond particles is then placed in the recess 22.

The substrate 20, loaded with the diamond particles, is placed in the reaction zone of a conventional high temperature/high pressure apparatus and subjected to diamond synthesis conditions. The catalyst/solvent and noble metal from the layer or cup infiltrate the diamond particles. At the same time, binder from the substrate 20 infiltrates the diamond particles. A diamond compact containing a second phase as defined above will thus be produced in the recess 22. This diamond compact will be bonded to the substrate 20. The sides of the substrate 20 may be removed, as shown by the dotted lines, to expose a cutting edge 30.

The composite diamond compact produced as described above has particular application where corrosive environments are experienced and more particularly in the abrading products which contain wood. Examples of wood products are natural wood, either soft or hard wood, laminated and non-laminated chipboard and fibreboard, which contain wood chips or fibre bonded by means of binders, hardboard which is compressed fibre and sawdust and plywood. The wood products may have a plastic or other coating applied to them. Some of these wood products may contain resins and organic binders. It has been found that the presence of corrosive cleaning chemicals and/or binder does not result in any significant undercutting of the cutting edge or point of the diamond compact. The abrading may take the form of sawing, milling or profile cutting.

The invention will now be further illustrated by the following examples. In these examples, the cemented carbide substrate used was that illustrated by FIG. 2.

EXAMPLE 1

A diamond compact bonded to a cemented carbide substrate was produced in a conventional high temperature/high pressure apparatus. A cylindrical cemented carbide substrate as illustrated by FIG. 2 was provided. The cemented carbide comprised a mass of carbide particles bonded with a binder consisting of an alloy of cobalt:ruthenium::80:20 by mass. A mass of diamond particles was placed in the recess of the substrate forming an unbonded assembly. The unbonded assembly was placed in the reaction zone of the high temperature/high pressure apparatus and subjected to a temperature of about 1500° C. and a pressure of about 55 kilobars (5.5 GPa). These conditions were maintained for a period sufficient to produce a diamond abrasive compact of the diamond particles, which compact was bonded to the cemented carbide substrate. The cobalt/ruthenium alloy from the substrate infiltrated the diamond particles during compact formation creating a second phase containing cobalt and ruthenium.

EXAMPLE 2

The procedure set out in Example 1 was followed save that the binder for the cemented carbide substrate was an alloy of cobalt:palladium::40:60 by mass. A composite diamond compact was produced.

EXAMPLE 3

A diamond compact bonded to a cemented carbide substrate was produced in a manner similar to that described in Example 1. In this example, the cemented carbide comprised a mass of carbide particles bonded with a cobalt binder. A shim consisting of an alloy of palladium:nickel::60:40 by mass was placed between the cemented carbide substrate and the diamond particles in the recess of the substrate. During compact formation, the palladium/nickel alloy, together with cobalt from the substrate, infiltrated the diamond particles producing a second phase containing palladium, nickel and cobalt. The second phase was rich in cobalt in the region closest to the compact substrate and became progressively leaner in cobalt towards the cutting surface and cutting edge of the compact. In the region of the cutting surface and cutting edge the second phase consisted always entirely of palladium and nickel and was found to be particularly resistant to corrosive materials.

EXAMPLES 4 and 5

The procedure set out in Example 3 was followed, save that shims having the following compositions were used:

| Example | Metals | Amount of Noble Metal (mass %) |
|---|---|---|
| 4 | Nickel - ruthenium | 15 |
| 5 | Cobalt - ruthenium | 15 |

Composite diamond compacts were produced in each example.

What is claimed:

1. A method of abrading a product where a corrosive environment is experienced which includes the steps of using, as the abrading element, a composite diamond compact comprising a diamond compact bonded to a cemented carbide substrate, the diamond compact comprising a polycrystalline mass of diamond particles present in an amount of at least 80% by volume of the compact and a second phase consisting essentially of diamond catalyst/solvent and a noble metal.

2. A method according to claim 1, wherein the diamond compact presents a working surface having a cutting edge.

3. A method according to claim 1, or claim 2 wherein the abrading takes the form of sawing, milling or profile cutting.

4. A method according to claim 1, wherein the product abraded contains wood.

5. A method according to claim 4, wherein the wood product is selected from the group consisting of natural wood, laminated and non-laminated chipboard, fibreboard, hardboard and plywood.

6. A method according to claim 4 wherein the wood product has a plastic or other coating applied to it.

7. A method according to claim 4, wherein the wood product contains a resin or organic binder.

8. A method according to claim 1, wherein the noble metal is selected from the group consisting of palladium and ruthenium.

9. A method according to claim 1, wherein the diamond catalystlsolvent is selected from the group consisting of cobalt, iron, nickel and an alloy containing one or more of these metals.

10. A method according to claim 1, wherein the second phase for the diamond compact contains cobalt and ruthenium, the ruthenium being present in an amount of 0.05 to 25 mass percent.

11. A method according to claim 1, wherein the second phase contains nickel and ruthenium, the ruthenium being present in an amount of 0.05 to 50 mass percent.

12. A method according to claim 1, wherein the second phase contains cobalt and palladium, the palladium being present in an amount of 0.05 to 75 mass percent.

13. A method according to claim 1, wherein the second phase contains nickel and palladium, the palladium being present in an amount of 0.05 to 75 mass percent.

14. A method according to claim 9, wherein the noble metal is selected from the group consisting of palladium and ruthenium.

15. A method according to claim 1, wherein the corrosive environment is an acidic environment.

* * * * *